US010369399B2

(12) United States Patent
Ross

(10) Patent No.: US 10,369,399 B2
(45) Date of Patent: Aug. 6, 2019

(54) HANDLE CONNECTOR FOR FLEXIBLE, ELONGATE EXERCISE COMPONENT

(71) Applicant: Exemplar Design, LLC, Mason, OH (US)

(72) Inventor: Adam L. Ross, Mason, OH (US)

(73) Assignee: EXEMPLAR DESIGN, LLC, Mason, OH (US)

( * ) Notice: Subject to any disclaimer, the term of this patent is extended or adjusted under 35 U.S.C. 154(b) by 344 days.

(21) Appl. No.: 15/449,439

(22) Filed: Mar. 3, 2017

(65) Prior Publication Data

US 2017/0252598 A1 Sep. 7, 2017

Related U.S. Application Data

(60) Provisional application No. 62/303,471, filed on Mar. 4, 2016.

(51) Int. Cl.

| | |
|---|---|
| ***A63B 5/04*** | (2006.01) |
| ***A63B 21/055*** | (2006.01) |
| ***A63B 21/00*** | (2006.01) |

(52) U.S. Cl.

CPC ..... *A63B 21/0557* (2013.01); *A63B 5/04* (2013.01); *A63B 21/4035* (2015.10)

(58) Field of Classification Search

None

See application file for complete search history.

(56) References Cited

U.S. PATENT DOCUMENTS

| | | | | |
|---|---|---|---|---|
| 8,075,462 | B1 * | 12/2011 | Hinds | A63B 21/4025 482/125 |
| 8,152,703 | B1 * | 4/2012 | Hinds | A63B 21/00065 482/122 |
| 8,480,549 | B1 * | 7/2013 | Hinds | A63B 7/02 482/121 |
| 9,119,985 | B2 | 9/2015 | Wagner et al. | |
| 9,308,411 | B2 * | 4/2016 | Friedberg | A63B 21/00061 |
| 2015/0366298 | A1 * | 12/2015 | Blackman | A44B 11/005 431/253 |

* cited by examiner

*Primary Examiner* — Stephen R Crow

(74) *Attorney, Agent, or Firm* — BakerHostetler

(57) ABSTRACT

The exercise system of the disclosure comprises one or more flexible, elongate exercise components, such as a resistance band, that is releasably connected to a handle via connector portion. In accordance with the disclosure, the connector portion generally comprises a base having a sliding lock thereon that slides in a direction normal to the exercise component to securely and releasably clamp a portion thereof between the sliding lock and the base portion.

20 Claims, 5 Drawing Sheets

HANDLE CONNECTOR FOR FLEXIBLE, ELONGATE EXERCISE COMPONENT

RELATED APPLICATIONS

This application claims the benefit of U.S. Provisional Application No. 62/303,471 filed on Mar. 4, 2016, the disclosure of which is incorporated herein by reference.

TECHNICAL FIELD

The present disclosure generally pertains to exercise apparatuses, such as elongate exercise apparatuses, like resistance bands, used for fitness and exercise. More particularly, the present disclosure pertains to a connector for releasably connecting elongate exercise apparatuses to a handle.

BACKGROUND

Elongate exercise apparatuses, such as resistance tubing, jump ropes, etc., sometimes come in different elasticities, lengths, weights, etc. to provide a user the ability to vary a workout routine. Typically, though, a handle is permanently affixed on each end of such elongate exercise apparatuses, thus requiring a user to purchase multiple apparatuses having multiple handles. Furthermore, if such apparatuses break, the entire apparatus, including the handles, must be discarded.

Conversely, there are some elongate exercise apparatuses that do allow for handle interchangeability. For example, U.S. Pat. No. 9,119,985 assigned to Exemplar Design, discloses such a system. More specifically, the '985 patent discloses a handle mechanism for use with resistance-type exercise bands that securely holds the resistance bands when in use but which can be relatively easily manipulated to switch out replacement bands (in the case of a breakage) or bands providing different resistances. The handles described in the '985 patent utilize a sliding wedge system such that the greater the force on the handles outwardly, when in use, the more securely the bands are held in place. The wedge system disclosed in the '985 patent moves in a direction parallel, or concentric, to the elongate exercise apparatus.

While the handles and system disclosed in the '985 patent are useful to provide an exchange handle for resistance bands and other elongate, flexible exercise apparatuses, other methods systems are desired. More specifically, it is desired to have such a handle connector system which quickly and easily may be used to exchange handles on elongate, flexible exercise apparatuses, wherein the locking portion of the connector slides in a direction normal to the elongate exercise apparatus being held thereby.

SUMMARY

In accordance with the disclosure, exercise systems, including elongate, flexible exercise apparatuses such as jump ropes, resistance bands, etc. are generally disclosed. Some example embodiments may include methods, apparatuses, and/or systems associated with connecting handles to such elongate exercise apparatuses.

The elongate exercise apparatus system of the present disclosure generally comprises at least one or more elongate, flexible exercise devices, such as resistance bands, and at least one handle for releasably securing the elongate exercise device to the handle when in use but which may be easily manipulated to remove and change out the elongate exercised apparatus in the case of a desire for the use of a different exercise apparatuses, such as ones that have different outer diameters, characteristics, lengths, etc.

More specifically, an exemplary exercise system in accordance with the disclosure may include an elongate, flexible exercise device, a handle and a connector for connecting the handle to the elongate flexible exercise device. The handle may be generally tubular shaped and have a resilient covering thereon. The connector may be comprised of a base and a sliding lock wherein the sliding lock may be slid to clamp and end of the elongate flexible exercise device between the base and the sliding lock.

The exercise systems disclosed herein may be made through molding and fabrication as would be known in the art.

The exercise systems disclosed herein may be used in multiple fields. Other fields include but are not limited to medical, construction, and industrial.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope. The disclosure will be described with additional specificity and detail through use of the accompanying drawings.

DETAILED DESCRIPTION

Figure 1:
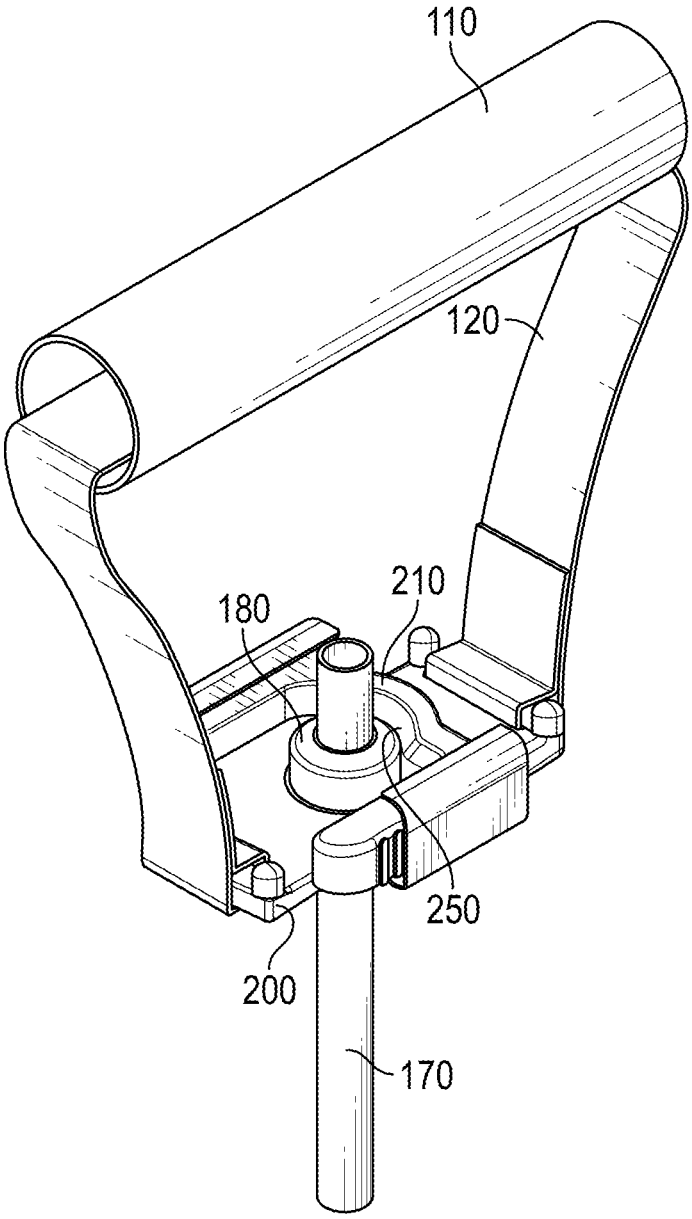
FIG. 1 is a perspective view of an exemplary handle and connector system for use in connection with flexible, elongate exercise apparatuses in accordance with one aspect of the disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Figure 2:
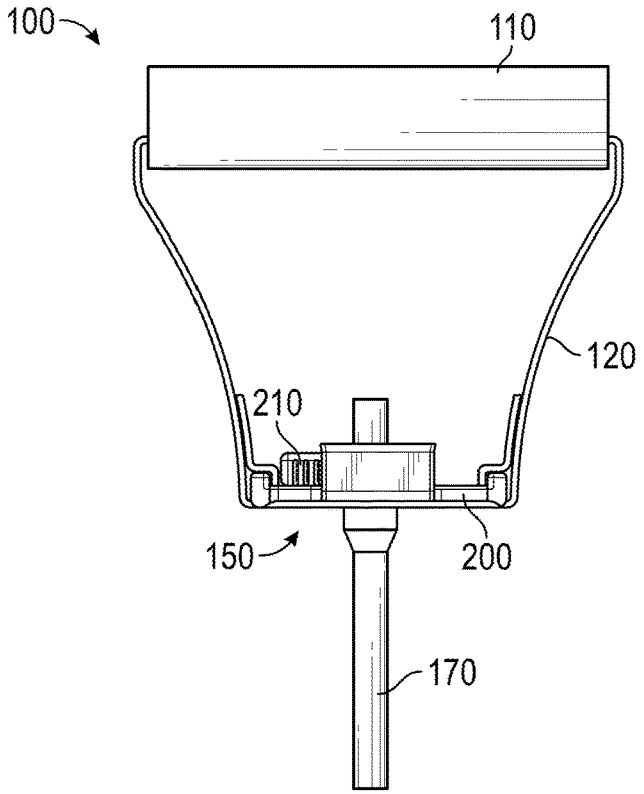
FIG. 2 is a front elevation of the handle and connector system of FIG. 1.
Figure 3:
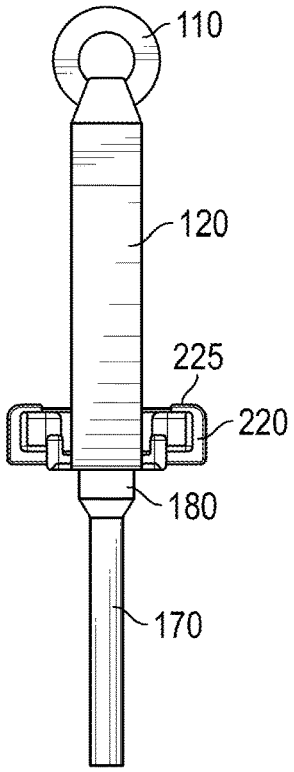
FIG. 3 is a side elevation of the handle and connector system of FIG. 1.

As best shown in FIGS. 1, 2 and 3 herein, an exemplary exercise system 100 may comprise at least one handle 110 shaped and sized to be gripped by a user. The handle 110 may be generally tubular shaped and have a resilient covering 115 thereon, such as foam or rubber. The handle 110 may have a strap 120 threaded thereto for attachment to a connector 150. The strap 120 may be comprised of nylon, rope, or other webbing material. The strap 120 may be connected to the connector 150 in any known manner including, for example, by looping a portion of the strap 120 through slots 160 on the ends of the connector 150 and then attaching the strap 120 to itself (such as by sewing, adhesives, rivets, etc.).

Figure 4:
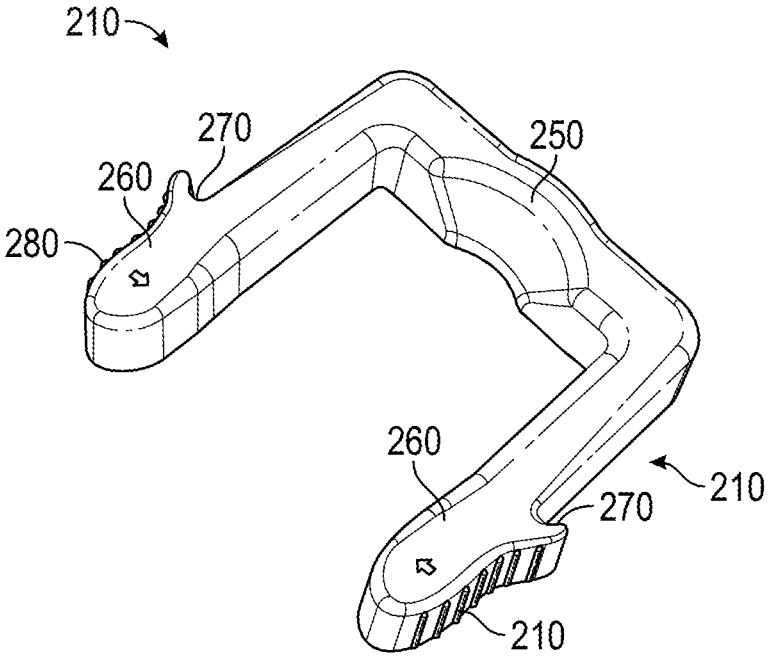
FIG. 4 is a perspective view of a sliding lock mechanism for use in connection with the exemplary handle and connector system of FIG. 1.
Figure 5:
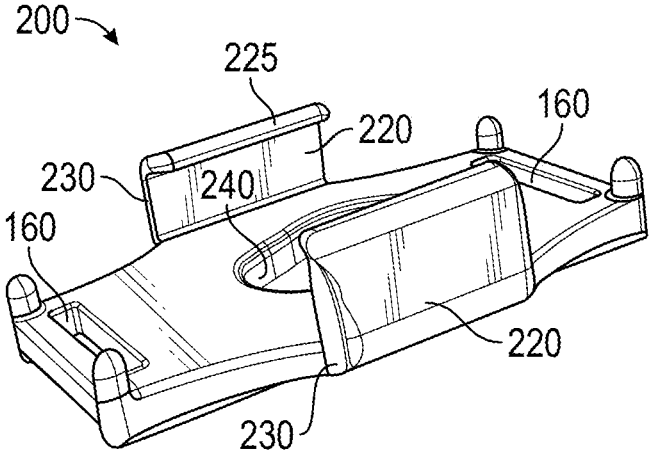
FIG. 5 is a perspective view of a base portion for use in connection with the exemplary handle and connector system of FIG. 1.
Figure 6:
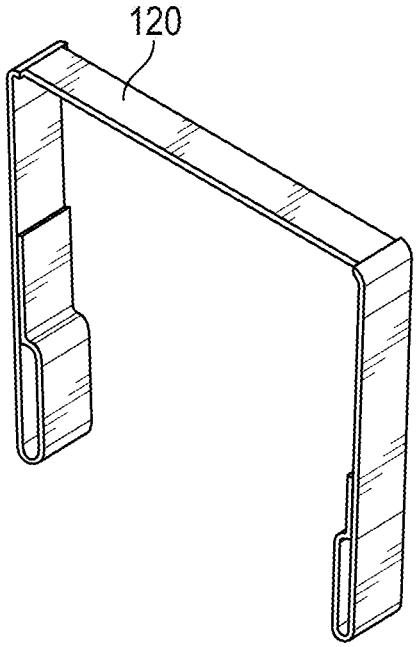
FIG. 6 is a perspective view of a web and attachment system for use in connection with the exemplary handle and connector system of FIG. 1.
Figure 7:
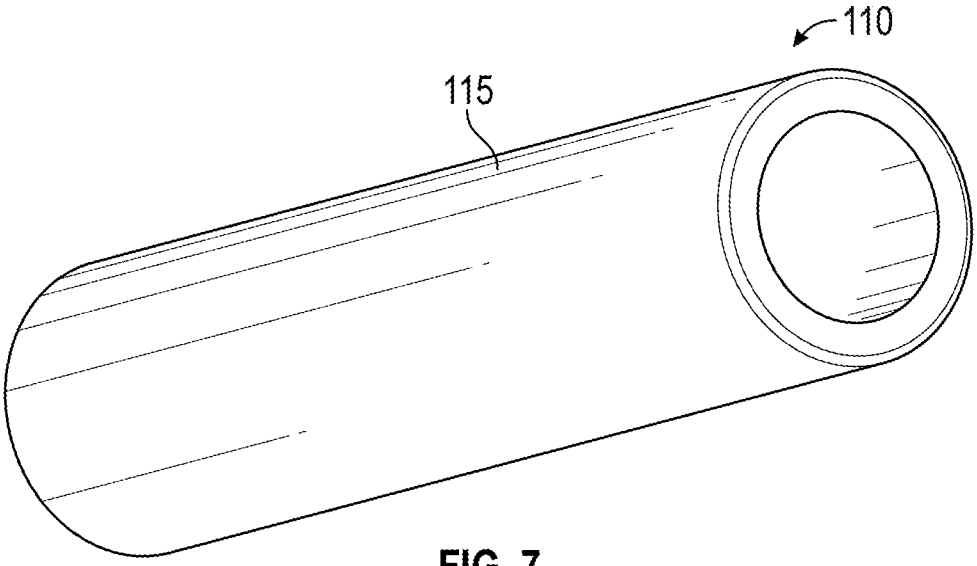
FIG. 7 is a perspective view of a handle for use in connection with the exemplary handle and connector system of FIG. 1.

The connector 150 may be used to releasably secure an elongate, flexible exercise apparatus, such as a resistance band 170 to the connector 150. In accordance with the disclosed embodiment, the resistance band 170 preferably includes a stop 180 attached proximate and end 190 thereof. The stop 180 may be conically-shaped and may be molded on or attached to the resistance band 170 near an end thereof As best shown in FIGS. 4 and 5, the connector 150 may be comprised of a base 200 and a sliding lock 210. The base 200 may include the slots 160 for receiving the strap 120, side clips 220 for slidingly receiving the sliding lock 210, the side clips 220 including retainers 225 and shoulders 230 thereon, and an orifice 240 therethrough, the orifice 240 being shaped so that the stop 180 may pass therethrough.

The sliding lock 210 may be generally C-shaped and is preferably made from a partially resilient material, such as nylon or plastic. The sliding lock 210 may include a scalloped engagement portion 250 thereon shaped and sized to engage the stop 180. As such, if the stop 180 is conically shaped, the engagement portion 250 may be conically shaped as well. The sliding lock 210 may include finger portions 260 on either side thereof having a catch portion 270 on a back thereof and a gripping portion 280 on a front portion thereof.

In operation, the sliding lock 210 may be placed and slidingly received on the base 200 by the side clips 220. Specifically, the side clip 220 retainers 225 may capture the upper portions of the finger portions 260 of the sliding lock 210. Then a user may insert the stop 180 of the resistance band 170 through the orifice 240 from the underside of the base 200. The user may then grasp the gripping portions 280 of the sliding lock 210, pushing inward, to allow the sliding lock 210 to slide along the base 200 in a direction directly normal, or perpendicular, to the resistance band 170 while avoiding interference from the side clips 220 until the engagement portion 250 engages the stop 180. The user may then release the gripping portions 280 allowing the catch portions 270 to engage the shoulders 230 of the side clips 220.

If it is desired to change or remove the selected resistance band 170, the foregoing steps may be followed in reverse. More specifically, a user may grip the gripping portions 280 of the sliding lock 210 and push inward while pulling out slightly thereby allowing the catch portions 270 to disengage the shoulders 230 of the side clips 220. The user may then push the sliding lock 210 backward in a direction directly normal to the resistance band 170, thereby allowing the user to remove the resistance band 170 stop 180 from the connector 150 by pulling the band 170 out from beneath the base 200.

Figure 8:
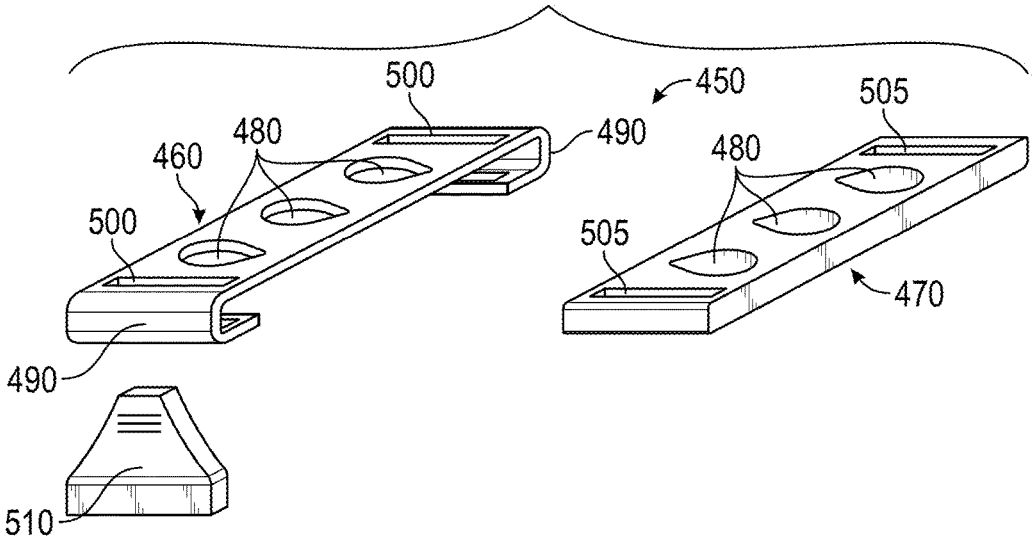
FIG. 8 is a perspective view of an alternate connector system for use in accordance with aspects of the disclosure.
Figure 9:
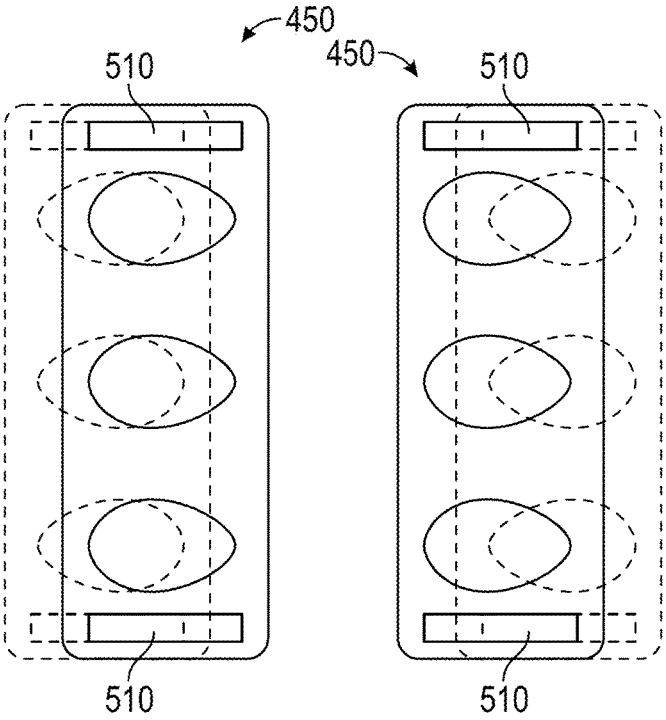
FIG. 9 is a top plan view of the alternate connector system of FIG. 8 shown in an engaged and disengaged configuration.

As best shown in FIGS. 8 and 9, alternate embodiments of the disclosure are within the scope of the invention as well. Specifically, the connector 450 may comprise a top portion 460 and a bottom portion 470, each having at least one orifice 480 therein. One of the top portion 460 or bottom portion may include clips 490 for receiving the other portion slidingly therein. The top 460 and bottom 470 portions may both include slots 500, 505 therein for receiving wedges 510 therethrough. In this embodiment, the user may place the elongate, flexible exercise apparatus(es) (not shown) through the orifice(s) 480. Once in the desired location, the user then places the wedges 510 through the slots 500, 505 pulling upward until the elongate, flexible exercise apparatus(es) are securely clamped between the top 460 and bottom portions 470 by the sideways movement thereof normal to the elongate flexible exercise apparatus(es). Other methods for locking the top 460 and bottom portions 470 (or the base 200 and sliding lock 210) could include a spring-loaded ball or pin and/or any other method as would be known in the art.

The various aspects and embodiments disclosed herein are for purposes of illustration and are not intended to be limiting, with the true scope and spirit being indicated by the following claims. Specifically, it is noted that while a resistance band is described as the elongate, flexible apparatus in the pictured embodiments, the disclosure is explicitly not limited to such embodiment and includes straps, jump ropes, etc. as well.

What is claimed is:

1. An exercise system, comprising:

an elongate flexible exercise apparatus having a stop on an end thereof;

a handle;

a connector attached to the handle, the connector having an orifice therethrough and at least two side clips thereon;

a sliding lock having an engagement portion and at least two fingers thereon shaped to slidingly engage the side clips such that when the stop is threaded through the orifice and the sliding lock is slid such that the engagement portion engages the stop, the elongate flexible apparatus is retained in the connector.

2. The exercise system of claim 1 wherein said at least one of said fingers includes a catch portion thereon.

3. The exercise system of claim 1 wherein said at least one of said fingers includes a gripping portion thereon.

4. The exercise system of claim 1 wherein the stop includes a conical portion.

5. The exercise system of claim 1 wherein the sliding lock is generally C-shaped.

6. The exercise system of claim 1 wherein the elongate flexible exercise apparatus is a resistance band.

7. The exercise system of claim 1 wherein the engagement portion is scalloped in shape.

8. The exercise system of claim 1 wherein the side clips are mounted proximate lateral edges of the connector.

9. The exercise system of claim 1 wherein the side clips are comprised of retainers and shoulders.

10. The exercise system of claim 1 wherein the handle is generally tubular in shape and attached to the connector via straps.

11. The exercise system of claim 10 wherein the connector includes slots therein for receiving said straps.

12. An exercise system, comprising:

an elongate flexible exercise apparatus having a stop on an end thereof;

a handle;

a connector attached to the handle, the connector comprising a flat plate-like member having an orifice therethrough and at least two side clips thereon, the side clips including retainers and shoulder portions;

a sliding lock having an engagement portion and at least two fingers thereon, the fingers having catch portions located proximate an end thereof, the sliding lock shaped to slidingly engage the side clips such that when the stop is threaded through the orifice and the sliding lock is slid such that the engagement portion engages the stop and the catch portions are prevented from respective rearward movement by the catch portions, the elongate flexible apparatus is retained in the connector.

13. The exercise system of claim 12 wherein said at least one of said fingers includes a gripping portion thereon.

14. The exercise system of claim 12 wherein the stop includes a conical portion.

15. The exercise system of claim 12 wherein the sliding lock is generally C-shaped.

16. The exercise system of claim 12 wherein the elongate flexible exercise apparatus is a resistance band.

17. The exercise system of claim 12 wherein the side clips are mounted proximate lateral edges of the connector.

18. An exercise system, comprising:

an elongate flexible exercise apparatus having a stop on an end thereof;

a first connector, the first connector having at least one orifice therethrough, at least two clips thereon, and at least one slot therein;

a second connector, the second connector having at least one orifice therethrough and at least one slot therein, and a triangular shaped wedge shaped to be simultaneously received through the slot in the first connector and the slot in the second connector such that movement thereof forces the first and second connector to slide with respect to each other.

19. The exercise system of claim 18 wherein at least one of the orifices in the first connector or second connector is tear drop shaped.

20. The exercise system of claim 18 further comprising a second slot in the first connector extending through at least one of the side clips.

* * * * *